US007013856B2

(12) United States Patent
Nakajima

(10) Patent No.: US 7,013,856 B2
(45) Date of Patent: Mar. 21, 2006

(54) VALVE TIMING CONTROL DEVICE

(75) Inventor: Shigeru Nakajima, Anjo (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 72 days.

(21) Appl. No.: 10/649,694

(22) Filed: Aug. 28, 2003

(65) Prior Publication Data

US 2004/0221825 A1 Nov. 11, 2004

(30) Foreign Application Priority Data

Aug. 28, 2002 (JP) ..... 2002-249250

(51) Int. Cl.
*F01L 1/34* (2006.01)

(52) U.S. Cl. ..... 123/90.17; 123/90.15; 123/90.31

(58) Field of Classification Search .. 123/90.15–90.18, 123/90.31; 74/568 R; 464/1, 2, 160; 92/121, 92/122

See application file for complete search history.

(56) References Cited

U.S. PATENT DOCUMENTS 5,870,983 A * 2/1999 Sato et al. ..... 123/90.17
6,032,626 A * 3/2000 Haag ..... 123/90.17
6,039,016 A * 3/2000 Noguchi ..... 123/90.17
6,662,769 B1 12/2003 Eguchi et al.
2001/0003974 A1 6/2001 Mizutani et al.
2002/0050258 A1 5/2002 Sato et al.
2002/0139330 A1 10/2002 Takahashi et al.

FOREIGN PATENT DOCUMENTS

DE 102 12 606 A1 3/2002
DE 102 13 825 A1 3/2002
JP 11-132014 5/1999

OTHER PUBLICATIONS

Copy of Official Letter dated Oct. 7, 2004.
English translation of Official Letter dated Oct. 7, 2004.

* cited by examiner

*Primary Examiner*—Thomas Denion
*Assistant Examiner*—Zelalem Eshete
(74) *Attorney, Agent, or Firm*—Buchanan Ingersoll PC

(57) ABSTRACT

A valve timing control device includes a rotor, a housing which can rotate relative to the rotor, a projecting portion which is formed on the housing so as to slide on the outer circumference of the rotor, a fluid chamber which is defined between the rotor and the housing, a vane which is provided on the rotor and which divides the fluid chamber into a retard angle chamber and an advance angle chamber and a torsion coil spring for urging the rotor relative to the housing in the advance angle direction in which the volume of the retard angle chamber decreases and the volume of the advance angle chamber increases and disposed in the twisted condition with a predetermined angle so as not to contact with the rotor and the housing frictionally.

12 Claims, 5 Drawing Sheets

VALVE TIMING CONTROL DEVICE

FIELD OF THE INVENTION

The present invention relates to a valve timing control device which controls open and close timing of intake or exhaust valves of a combustion engine.

BACKGROUND OF THE INVENTION

A conventional device of this kind is disclosed, for example, in Japanese Patent Laid-Open Publication No. 11-132014. This device includes a rotor, a housing which can rotate relative to the rotor, a projecting portion which is formed on the housing so as to slide on the outer circumference of the rotor, a fluid chamber which is defined between the rotor and the housing, a vane which is provided on the rotor and which divides the fluid chamber into a retard angle chamber and an advance angle chamber and a torsion coil spring for urging the rotor relative to the housing in the advance angle direction in which the volume of the retard angle chamber decreases and the volume of the advance angle chamber increases. The torsion coil spring is provided considering the force which operates the rotor relative to the housing in the retard angle direction due to the fluctuation torque constantly operating to the cam shaft during the running of the engine. The torsion coil spring improves the response of the rotation of the rotor toward the advance side. One end of the torsion coil spring is engaged with a first groove which is formed on a plate connected to the housing and the other end thereof is engaged with a second groove formed on the rotor.

In the above prior art, a first hook portion which is extended in the axial direction of a coil portion of the torsion spring is formed on one end of the torsion spring. The first hook portion is inserted into a first hook engaging hole formed on a groove bottom of the first groove and is engaged with the first hook engaging hole. A second hook portion which is extended in the axial direction of the coil portion of the torsion spring is formed on the other end of the torsion spring. The second hook portion is inserted into a second hook engaging hole formed on a groove bottom of the second groove and is engaged with the second hook engaging hole.

In the above prior device, in order to hold the position of the torsion coil spring, the coil portion located at one end of the torsion coil spring is engaged with a projection and a spiral groove which are formed on the plate. Therefore, the inner and outer diameter of the coil spring changes by the change of the twisting angle of the torsion coil spring during the operation of the valve timing control device. As a result, the coil portion contacts frictionally with the projection and the spiral groove and therefore the torsion coil spring can not apply the desired twisting torque.

SUMMARY OF THE INVENTION

It is, therefore, an object of the present invention to provide a valve timing control device in which a torsion coil spring can apply stably the desired twisting torque. In order to achieve the foregoing object, the present invention provides a valve timing control device which includes a rotor, a housing which can rotate relative to the rotor, a projecting portion which is formed on the housing so as to slide on the outer circumference of the rotor, a fluid chamber which is defined between the rotor and the housing, a vane which is provided on the rotor and which divides the fluid chamber into a retard angle chamber and an advance angle chamber and a torsion coil spring for urging the rotor relative to the housing in the advance angle direction in which the volume of the retard angle chamber decreases and the volume of the advance angle chamber increases and disposed in the twisted condition with a predetermined angle so as not to contact with the rotor and the housing frictionally.

DETAILED DESCRIPTION OF THE PRESENT INVENTION

Hereinafter, preferred embodiments of the present invention will be concretely described with referent to the drawings.

Figure 1:
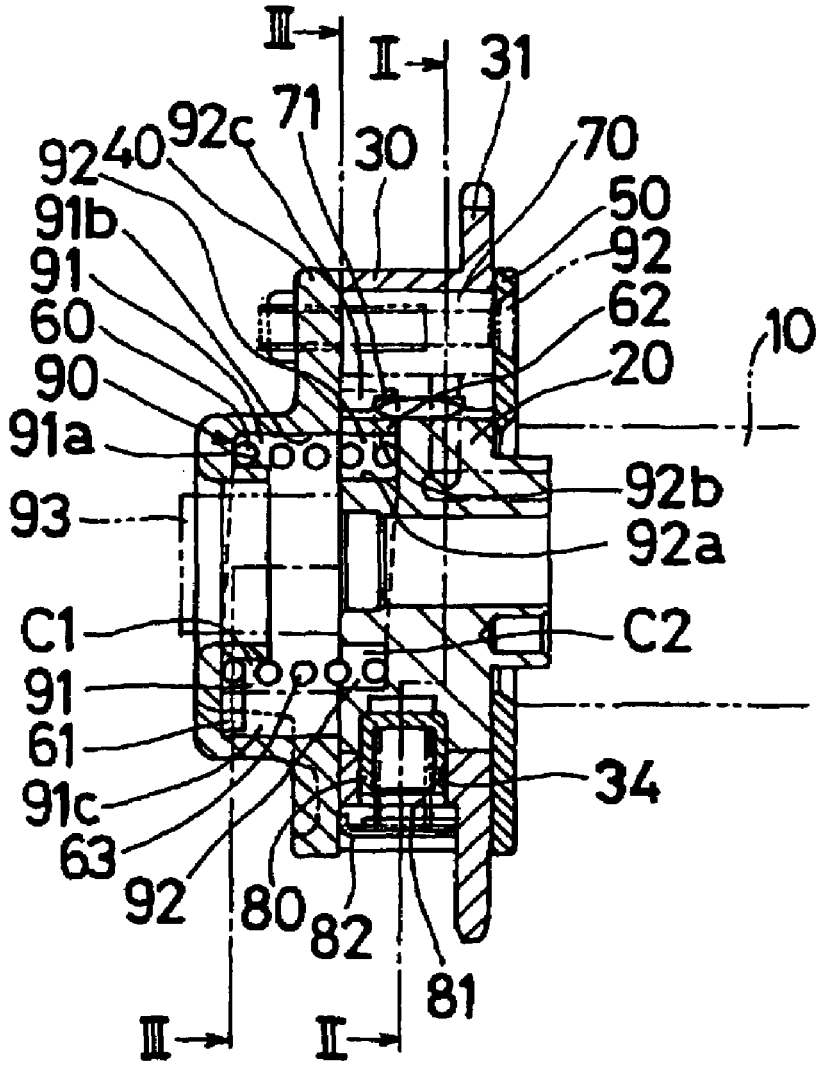
FIG. 1 shows a sectional view of an embodiment of a valve timing control device in accordance with the present invention.
Figure 2:
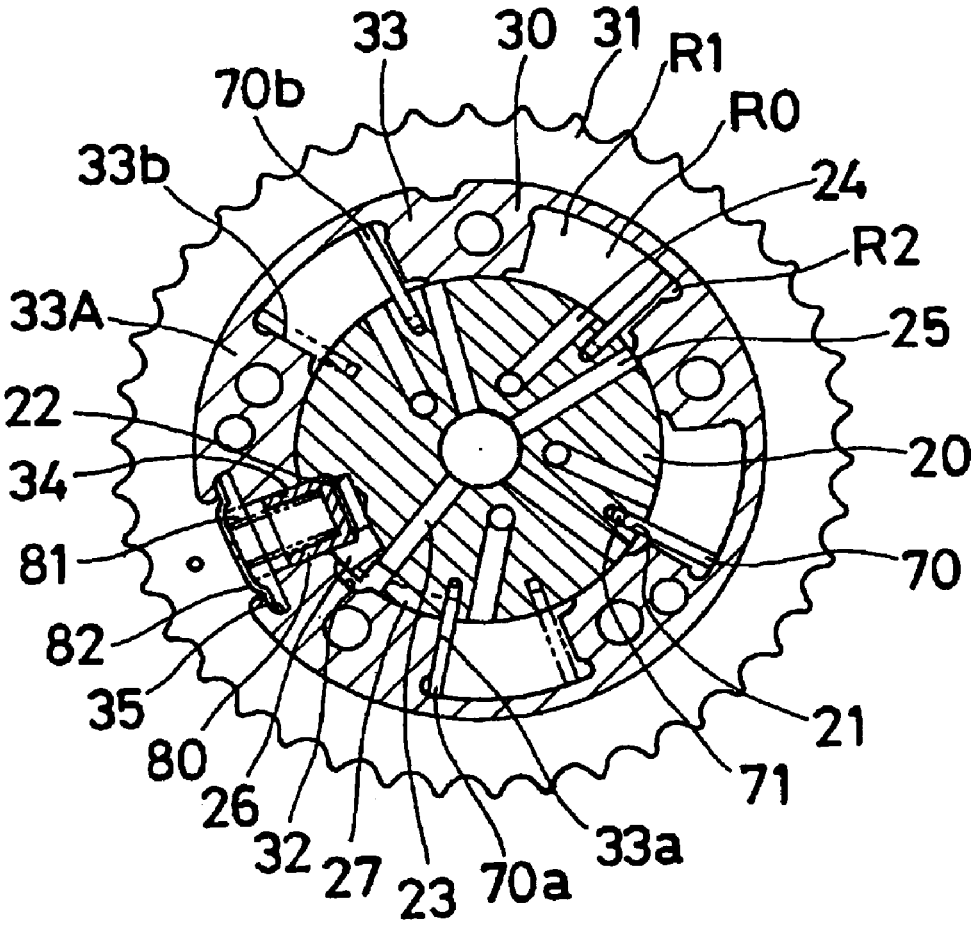
FIG. 2 shows a sectional view taking along II—II line in FIG. 1.

A valve timing control device shown in FIG. 1 and FIG. 2 includes a cam shaft 10 rotatably supported on a cylinder head (not shown) of an engine and having cams (not shown) for opening and closing valves, a rotor 20 integrally mounted on a top end of the cam shaft 10, a rotation transmitting member comprising a housing 30 mounted on the rotor 20 so as to be able to rotate relative to the rotor 20 within a predetermined angle, a front plate (plate) 40, a rear plate 50 and a timing sprocket 31 integrally formed on the housing 30, a torsion spring (torsion coil spring) disposed between the rotor 20 and the front plate 40, four vanes 70 mounted on the rotor 20 and a lock pin 80 disposed in the housing 30.

As shown in FIG. 1, the housing 30 is mounted on the outer circumference of the rotor 20 so as to be able to rotate relative to the rotor 20 within a predetermined angle. The front plate 40 and the rear plate 50 are fixed to both ends of the housing 30 by four bolts 92. The timing sprocket 31 is integrally formed on the rear end side of the outer circumference of the housing 30 to which the rear plate 50 is fixed. A transmitting member such as a timing chain or a timing belt (not shown) is disposed between the timing sprocket 31 and a sprocket of a crank shaft (not shown) of the engine. When the crank shaft is rotated, the timing sprocket 31 rotates through the transmitting member and the housing 30 rotates with the front plate 40 and the rear plate 50. Then, the rotor 20 rotates and the cam shaft 10 which is integrally mounted on the rotor 20 rotates, and the cams of the cam shaft 10 open and close the valves of the engine.

Four projecting portions 33 are formed on the inner circumference of the housing 30 with a predetermined interval in the circumferential direction so as to project inward in the radial direction. The inner circumferential surface of the projecting portions 33 contact with the outer circumferential surface of the rotor 20 so as to be able to slide in the circumferential direction. Thereby, the housing 30 is rotatably supported on the housing 30. Fluid chambers R0 are formed between the adjacent projecting portions 33 of the housing 30 and the outer circumferential surface of the rotor 20. In one 33A of the projection portions 33, a refuging hole 34 in which the lock pin 80 a spring 81 for urging the lock pin 80 are disposed and a groove 35 in which a retainer 82 for engaging one end of the spring 81 are formed. The circumferential width of the projection portion 33A is set larger than that of the other projection portions in order to ensure the stiffness of the housing 30.

The rotor 20 is fixed to the cam shaft 10 by a single bolt 93 and includes vane grooves 21 for mounting the vanes 70 movably in the radial direction, respectively. Further, the rotor 20 includes a receiving hole 22 in which a cylindrical head portion of the lock pin 80 is fitted with a predetermined amount when the relative position between the rotor 20 and the housing 30 becomes a predetermined relative phase (most advance angle), a communicating hole 26 and a passage 23 which supply and discharge the operation fluid to or from the receiving hole 22 through an axial groove 32 formed on the outer circumference of the housing 30 in the axial direction, passages 25 which supply and discharge the operation fluid to or from retard angle pressure chambers R2 (except for a chamber R2 located at underpart in FIG. 2) divided in the fluid chambers R0 by the vanes 70 and passages 24 which supply and discharge the operation fluid to or from advance angle chambers R1 divided in the fluid chambers R0 by the vanes 70. The operation fluid is supplied and discharged to or from the retard angle chamber R2 located at underpart in FIG. 2 through a circumferential groove 27 which is formed on the outer circumference of the rotor 20 and to which the outer end of the passage 23 is communicated. In such structure, the operation fluid is supplied and discharged to or from the receiving hole 22 only when the relative position between the rotor 20 and the housing 30 becomes most advance angle position. The vanes 70 are urged outward in the radial direction by vane springs 71 which are disposed in the bottom portions of the vane grooves 21, respectively. Further, the inner diameter of the receiving hole 22 is set larger than the outer diameter of the lock pin 80 with small amount.

When the engine stops, as shown in FIG. 2, the relative position between the rotor 20 and the housing 30 is in the most advance angle position, and the vane 70*a* contacts with the end surface 33*a* of the projecting portion 33 and functions as a stopper which prevent the rotor 20 from rotating toward the advance angle side. Further, when the relative position between the rotor 20 and the housing 30 is in the most advance angle position, the head portion of the lock pin 80 is fitted into the receiving hole 22 of the rotor 20 and is locked. Therefore, since the lock pin 80 functions as a stopper which prevent the rotor 20 from rotating toward the retard angle side and the vane 70*a* functions as the stopper which prevent the rotor 20 from rotating toward the advance angle side, the rotor 20 can not rotate relative to the housing in the advance angle and retard angle direction and is regulated. It is desirable that the engine is started under the regulated condition of the rotor 20 in this manner. When the engine is started, since the pressure of the operation fluid of the engine is not stable enough, the vanes 70 move in the circumferential direction and make flip-flop. As mentioned above, since the advance angle direction stopper and the retard angle direction stopper function, the movement of the vanes 70 just behind the start of the engine is prevented.

When time goes by after the start of the engine and the pressure of the operation fluid of the engine is stable, the operation fluid is supplied to the receiving hole 22 through the passage 23 and the communicating hole 26 formed on the rotor 20 and the axial groove 32 formed on the housing 30, and the lock pin 80 is moved outward in the radial direction and is released. When the lock pin 80 is released, the rotation of the rotor 20 relative to the housing 30 is allowed and consequently it is able to adjust the rotation phase of the cam shaft 10 relative to the rotation phase of the crank shaft in the advance angle direction or the retard angle direction.

In this case, when the operation fluid in the advance angle chambers R1 is discharged from the advance angle passages 24 and the operation fluid is supplied to the retard angle chambers R2 from the retard angle passages 25, the rotor 20 rotates with the vanes 70 relative to the housing 30 toward the retard angle direction so as to increase the volume of each retard angle chambers R2 and to decrease the volume of each advance angle chambers R1. In the most retard angle position, the vane 70*b* contacts with the end surface 33*b* of the projecting portion 33 and functions as a stopper which prevent the rotor 20 from rotating toward the retard angle side.

On the other hand, when the operation fluid in the retard angle chambers R2 is discharged from the retard angle passages 25 and the operation fluid is supplied to the advance angle chambers R1 from the advance angle passages 24 under the released condition of the lock pin 80, the rotor 20 rotates with the vanes 70 relative to the housing 30 toward the advance angle direction so as to increase the volume of each advance angle chambers R1 and to decrease the volume of each retard angle chambers R2.

In this embodiment, as shown in FIG. 1, a circular receiving chamber 90 in which the torsion spring 60 is disposed is formed coaxially by the front plate 40 and the rotor 20. The receiving chamber 90 is formed by a circular first receiving groove 91 which is opened from the surface of the front plate 40 connected to the rotor 20 and a circular second receiving groove 92 which is opened from the surface of the rotor 20 connected to the front plate 40.

The first receiving groove 91 of the front plate 40 includes an inner circumferential surface 91*a* which is a circular wall surface, an outer circumferantial surface 91*b* which is a circular wall surface and a first engaging portion 91*c* which is partly caved from the receiving groove 91 outward in the radial direction. The first engaging portion 91*c* is partly caved from the outer circumferential surface 91*b* outward in the radial direction, namely, toward the extended direction of a first hook portion 61 of the torsion spring 60. The second receiving groove 92 of the rotor 20 includes an inner circumferential surface 92*a* which is a circular wall surface, an outer circumferantial surface 92*b* which is a circular wall surface and a second engaging portion 92*c* which is partly caved from the receiving groove 92 outward in the radial direction. The second engaging portion 92*c* is partly caved from the outer circumferantial surface 92*b* outward in the radial direction, namely, toward the extended direction of a second hook portion 62 of the torsion spring 60.

Thereby, since the first engaging portion 91*c* opened on the surface of the front plate 40 connected to the rotor 20 and the second engaging portion 92*c* opened on the surface of the rotor 20 connected to the front plate 40 are formed, when the torsion spring 60 is engaged with the front plate 40 and the rotor 20, the first hook portion 61 can be engaged along the opening of the first engaging portion 91*c* of the front plate 40 and the second hook portion 62 can be engaged along the opening of the second engaging portion 92*c* of the rotor 20, and it is able to mount the torsion spring easily.

Figure 3:
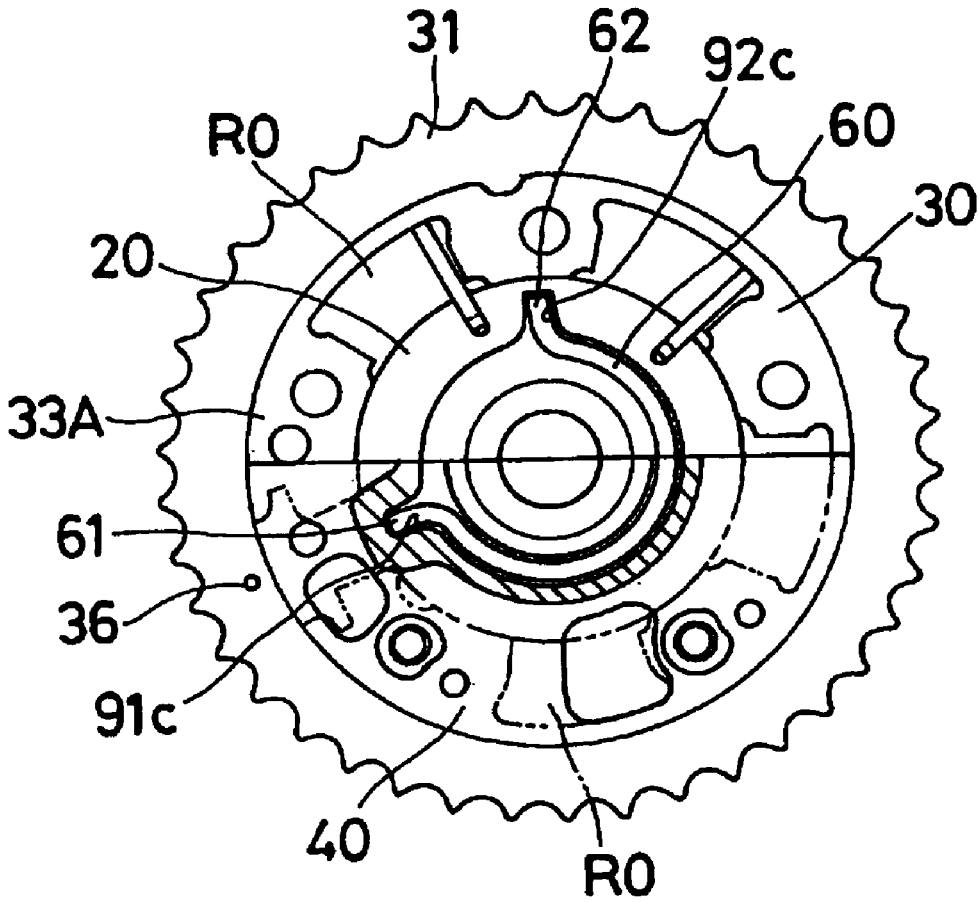
FIG. 3 shows a sectional view taking along III—III line in FIG. 1.

When the front plate 40, the housing 30 and the rear plate 50 are integrally assembled, the first engaging portion 91*c* opened on the surface of the front plate 40 connected to the rotor 20 interferes with the fluid chamber R0 due to the declination of each axial centers and there is in danger that the leak of the operation fluid from the fluid chamber R0 is generated. According to this embodiment, as shown in FIG. 3, since the first engaging portion 91*c* of the front plate 40 is disposed at the approximately same position with respect to the approximately circumferential center portion of the projection portion 33A which has a maximum circumferential width and is assembled, namely, the first engaging portion 91*c* is disposed at the position separated from the fluid chamber R0, it is able to prevent that the operation fluid leaks from the fluid chamber R0 to the receiving chamber 90.

In this case, it is desirable to provide a point mark 36 on the housing 30 in order to dispose and assemble the first engaging portion 91*c* of the front plate 40 at the approximately same position with respect to the projection portion 33A.

Figure 4:
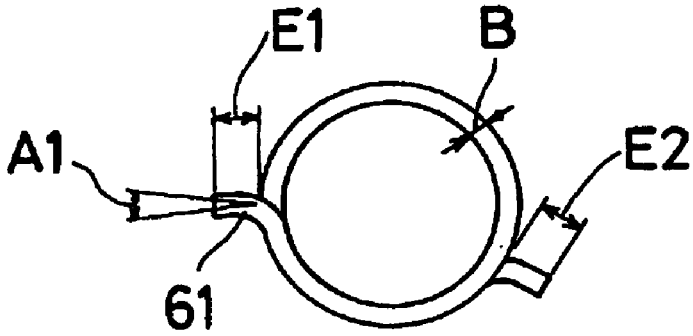
FIG. 4 shows an end elevational view of a torsion coil spring of an embodiment of a valve timing control device.
Figure 5:
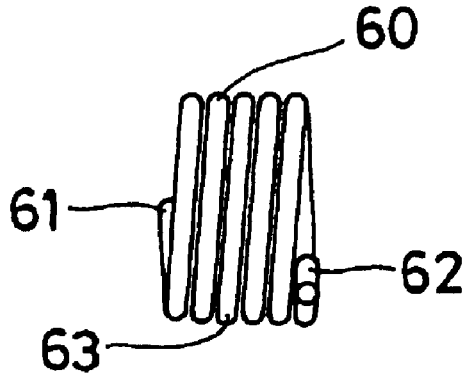
FIG. 5 shows a side view of a torsion coil spring of an embodiment of a valve timing control device.

As shown in FIG. 1, the torsion spring 60 is disposed in the receiving chamber 90 approximately coaxially with the rotor 20. The torsion spring 60 is formed by bending metal wire rods having a circle cross section in coil shape. The torsion spring 60 includes a coil portion 63 having an axial center extended along the axial center of the rotor 20, the first hook portion 61 extended from one end of the axial direction of the coil portion 63 outward in the radial direction and the second hook portion 62 extended from the other end of the axial direction of the coil portion 63 outward in the radial direction. In FIG. 4 and FIG. 5, the extending amount of the first hook portion 61 is shown as E1 and the extending angle of the first hook portion 61 is shown as A1. The extending amount of the second hook portion 62 is shown as E2 and the extending angle of the second hook portion 62 is shown as A2. It is desirable that $2B \leqq E1$, $E2 \leqq 3B$ (where, B: diameter of the torsion spring 60). Further, it is desirable that $0 \leqq A1$, $A2 \leqq 30°$.

In this embodiment, as shown in FIG. 1, a clearance C1 is formed between the inner and outer circumferential surface 91*a*, 91*b* of the first receiving groove 91 of the receiving chamber 90 and the coil portion 63 of the torsion spring 60. Similarly, a clearance C2 is formed between the inner and outer circumferential surface 92*a*, 92*b* of the second receiving groove 92 of the receiving chamber 90 and the coil portion 63 of the torsion spring 60.

When the rotor 20 rotates relative to the housing 30, the spring force of the torsion spring 60 is brought out. In this time, since the clearances C1, C2 are formed, it is able to prevent the generation of the excessive friction resistance by the contact between the coil portion 63 of the torsion spring 60 and the inner and outer circumferential surface 91*a*, 91*b* of the first receiving groove 91, the inner and outer circumferential surface 92*a*, 92*b* of the second receiving groove 92. This is advantageous for bringing out of the intended spring force of the torsion spring 60. It is desirable that C1, $C2 \geqq 0.3$.

When the rotor 20 rotates relative to the housing 30 against the spring force of the torsion spring 60, there is a tendency to elastically deform the coil portion 63 so as to decrease the diameter of the coil portion 63. Further, since the clearance C1,C2 are provided around the torsion spring 60, when the rotor 20 rotates relative to the housing 30 against the spring force of the torsion spring 60, the coil portion 63 of the torsion spring 60 easily deforms elastically so as to decrease the diameter of the coil portion 63. In this time, there is a tendency that the first hook portion 61 and the second hook portion 62 of the torsion spring 60 is apt to be disengaged. According to this embodiment, the first hook portion 61 and the second hook portion 62 are extended from the coil portion 63 outward in the radial direction, the first hook portion 61 and the second hook portion 62 are prevented from disengaging from the first and second engaging portions 91*c*, 92*c*.

Further, since the extending amounts E1, E2 of the first and second hook portions 61, 62 are set to $2B \leqq E1$, $E2 \leqq 3B$ and the extending angles A1, A2 of the first and second hook portions 61, 62 are set to $0 \leqq A1$, $A2 \leqq 30°$, the engaging amount between the first hook portion 61 and the first engaging portion 91*c* and the engaging amount between the second hook portion 62 and the second engaging portion 92*c* are ensured. Therefore, the first hook portion 61 and the second hook portion 62 are effectively prevented from disengaging from the first and second engaging portions 91*c*, 92*c*.

Figure 6:
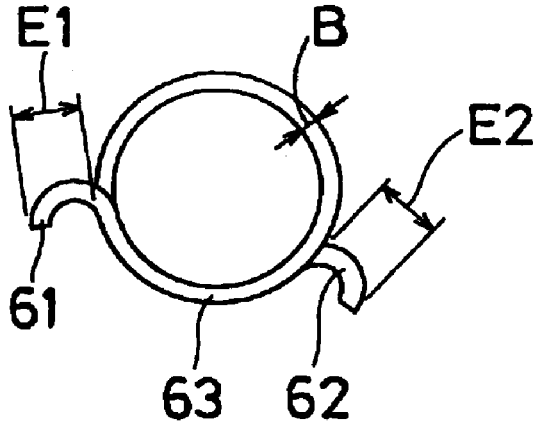
FIG. 6 shows an end elevational view of a torsion coil spring of another embodiment of a valve timing control device.
Figure 7:
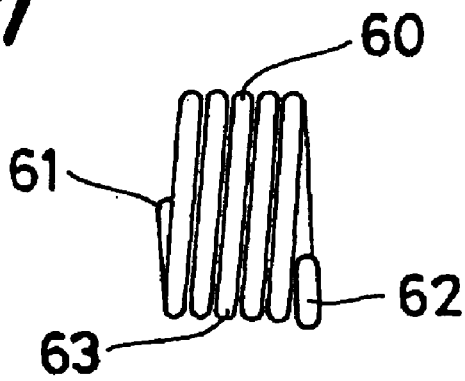
FIG. 7 shows a side view of a torsion coil spring of another embodiment of a valve timing control device.

Further, as shown in FIG. 6 and FIG. 7, the first hook portion 61 and the second hook portion 62 are formed in R shape and pins are formed in the receiving groove 91 of the front plate 40 and the receiving groove 92 of the rotor 20 for hitching the first hook portion 61 and the second hook portion 62. Thereby, the first hook portion 61 and the second hook portion 62 are effectively prevented from disengaging from the first and second engaging portions 91*c*, 92*c*.

The torsion spring 60 has an urging force which urges always the rotor 20 holding the vanes 70 relative to the housing 30 clockwise in FIG. 2. The torsion spring 60 is provided considering the force which operates the rotor 20 relative to the housing 30 in the retard angle direction due to the fluctuation torque constantly operating to the cam shaft 10 during the running of the engine. The torsion spring 60 urges always the rotor 20 relative to the housing 30 in the advance angle direction and thereby the response of the rotation of the rotor 20 toward the advance side is improved.

The torsion spring 60 is assembled under the twisted condition so as to urge always the rotor 20 relative to the housing 30. The front plate 40 in which the first hook portion 61 is engaged and the rotor 20 in which the second hook portion 62 is engaged are rotated relative to each other and are assembled so that the torsion spring 60 is twisted. In this time, in case of that the twisting angle (torsional angle) is large, namely, in case of that the rotational angle is large, there is in danger that the time for assembling increases and that the assembling deteriorates due to the decrease of the angle accuracy of the rotational angle of the front plate 40 and the rotor 20. According to the embodiment, since the maximum twisting angle (torsional angle) is within 360°, it is able to reduce the time for assembling and it is able to improve the angle accuracy of the rotational angle of the front plate 40 and the rotor 20 and the assembling can be surely done.

Figure 8:
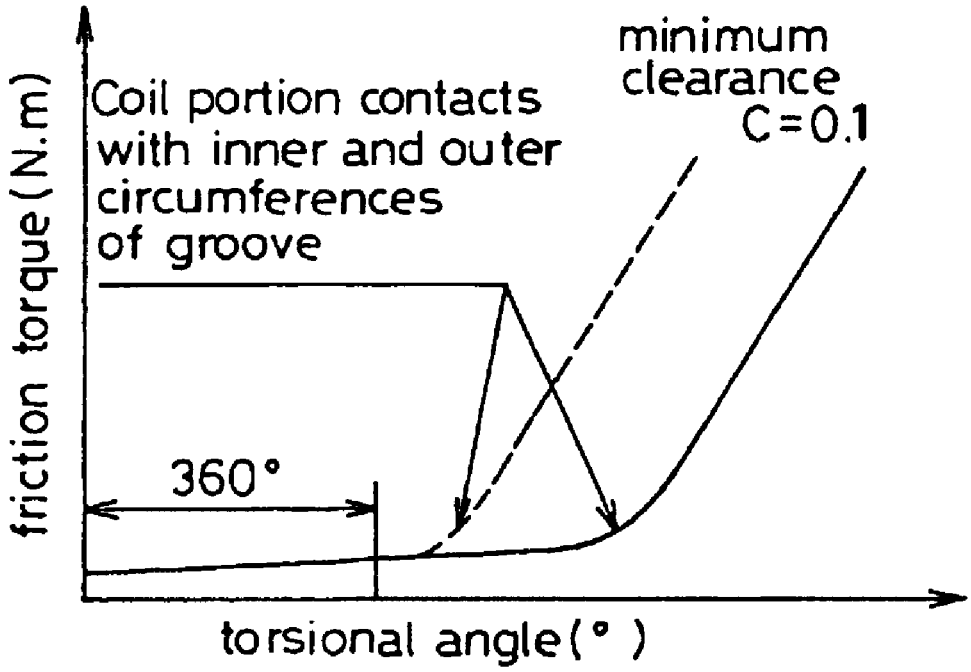
FIG. 8 is a diagram which shows a relationship between a torsional angle of the torsion coil spring and a friction resistance (friction torque).

Further, as mentioned above, when the rotor 20 rotates relative to the housing 30 against the spring force of the torsion spring 60, there is a tendency to elastically deform the coil portion 63 so as to decrease the diameter of the coil portion 63. In this time, in case of that the twisting angle (torsional angle) of the torsion spring 60 is large as shown in FIG. 8, the coil portion 63 contacts with the inner and outer circumferential surfaces 91*a*, 91*b* of the first receiving groove 91 and the inner and outer circumferential surfaces

92*a*, 92*b* of the second receiving groove 92 and there is in danger that the excessive friction resistance generates. According to the embodiment, since the maximum twisting angle (torsional angle) is within 360°, the friction contact is prevented and the stable twisting torque is generated, and the appropriate operation can be obtained.

In the above mentioned embodiment, the present invention is applied to a valve timing control device assembled to an exhaust cam shaft. However, the present invention can be applied to a valve timing control device assembled to an intake cam shaft.

Further, in the above mentioned embodiment, the valve timing control device is constituted so that the head portion of the lock pin 80 assembled on the housing 30 is inserted into the receiving hole 22 of the rotor 20 under the condition which the retard angle chamber R2 is in minimum volume (most advance angle condition). However, the valve timing control device may be constituted so that the head portion of the lock pin 80 assembled on the housing 30 is inserted into the receiving hole 22 of the rotor 20 under the condition which the advance angle chamber R1 is in minimum volume (most retard angle condition).

According to the present invention, it is able to prevent the friction by the contact between the torsion spring and the rotor, the housing and the twisting torque can be stabilized, and the time for assembling can be decreased. Further, it is able to improve the angle accuracy of the rotational angle of the plate and the rotor and it is able to assemble surely and easily.

What is claimed is:

1. A valve timing control device comprising:

a rotor, a housing which can rotate relative to the rotor, a projecting portion which is formed on the housing so as to slide on the outer circumference of the rotor, the projecting portion possessing circumferentially spaced apart ends, a fluid chamber which is defined between the rotor and the housing, a vane which is provided on the rotor and which divides the fluid chamber into a retard angle chamber and an advance angle chamber, a torsion coil spring for urging the rotor relative to the housing in the advance angle direction in which the volume of the retard angle chamber decreases and the volume of the advance angle chamber increases, a first hook portion formed on one end of a coil portion of the torsion spring, a first engaging portion provided in a first receiving groove formed on a plate connected to the housing and engaged with the first hook portion, the first engaging portion opening toward a surface of the plate contacting the rotor, and the first engaging portion being circumferentially positioned between the ends of the projecting portion.

2. A valve timing control device as recited in claim 1, wherein the maximum twisted angle of the torsion spring is 360°.

3. A valve timing control device as recited in claim 1, wherein the first engaging portion is disposed at approximately a circumferential center portion of the projecting portion.

4. A valve timing control device as recited in claim 1, wherein the first hook portion extends in a radial direction of the coil portion of the torsion coil spring.

5. A valve timing control device as recited in claim 1, further comprising a second hook portion formed on an end of the torsion coil spring opposite the one end, and a second engaging portion provided in a second receiving groove formed on the rotor and engaged with the second hook portion, the second engaging portion opening toward a surface of the rotor contacting the plate.

6. A valve timing control device as recited in claim 5, wherein the second hook portion extends in a radial direction of the coil portion of the torsion coil spring.

7. A valve timing control device comprising:

a rotor, a housing rotatable relative to the rotor, a plurality of projecting portions formed on the housing to slide on an outer circumference of the rotor, each of the projecting portions possessing circumferentially spaced apart ends, one of the projecting portions having a greater circumferential extent than the other projecting portions, a fluid chamber defined between the rotor and the housing, a vane provided on the rotor and dividing the fluid chamber into a retard angle chamber and an advance angle chamber, a torsion coil spring urging the rotor relative to the housing, a first hook portion formed on one end of a coil portion of the torsion spring, a first engaging portion provided in a first receiving groove formed on a plate connected to the housing and engaged with the first hook portion, and the first engaging portion opening toward a surface of the plate contacting the rotor, and the first engaging portion being circumferentially positioned between the ends of said one projecting portion having the greater circumferential extent than the other projecting portions.

8. A valve timing control device as recited in claim 7, wherein the maximum twisted angle of the torsion spring is within 360°.

9. A valve timing control device as recited in claim 7, wherein the first engaging portion is disposed at approximately a circumferential center portion of said one projecting portion having the greater circumferential extent than the other projecting portions.

10. A valve timing control device as recited in claim 7, wherein the first hook portion extends in a radial direction of the coil portion of the torsion coil spring.

11. A valve timing control device as recited in claim 7, further comprising a second hook portion formed on an end of the torsion coil spring opposite the one end, and a second engaging portion provided in a second receiving groove formed on the rotor and engaged with the second hook portion, the second engaging portion opening toward a surface of the rotor contacting the plate.

12. A valve timing control device as recited in claim 11, wherein the second hook portion extends in a radial direction of the coil portion of the torsion coil spring.

* * * * *